United States Patent [19]

Adleman

[11] Patent Number: 4,899,447

[45] Date of Patent: Feb. 13, 1990

[54] PANEL PUNCH

[75] Inventor: Larry Adleman, Rockford, Ill.

[73] Assignee: Greenlee Textron Inc., Rockford, Ill.

[21] Appl. No.: 147,221

[22] Filed: Jan. 22, 1988

[51] Int. Cl.[4] ..... B26F 1/00

[52] U.S. Cl. ..... 30/360; 30/361

[58] Field of Search ..... 30/360, 361, 358, 229; 29/407; 83/688, 689, 684, 685, 682

[56] References Cited

U.S. PATENT DOCUMENTS

| | | | |
|---|---|---|---|
| 1,372,630 | 3/1921 | Reece' | 83/682 |
| 2,250,434 | 7/1941 | Dugaw | 30/358 |
| 4,481,700 | 11/1984 | Redmon | 30/360 |
| 4,724,616 | 2/1988 | Adleman et al. | 30/360 |

FOREIGN PATENT DOCUMENTS

| | | | |
|---|---|---|---|
| 0153528 | 1/1982 | Fed. Rep. of Germany | 83/688 |
| 851760 | 10/1939 | France | 30/360 |

*Primary Examiner*—Hien H. Phan

*Attorney, Agent, or Firm*—R. A. Giangiorgi

[57] ABSTRACT

The panel punch includes a main punch configured to punch a trapezoidal opening in an electrical panel to receive an electrical chassis connector and a secondary punch integral with the main punch and extending from opposite ends thereof configured to punch a U-shaped slot in the panel extending from the ends of the trapezoidal opening to receive mounting screws for physically attaching the electrical connector to the panel.

12 Claims, 4 Drawing Sheets

FIG. 8
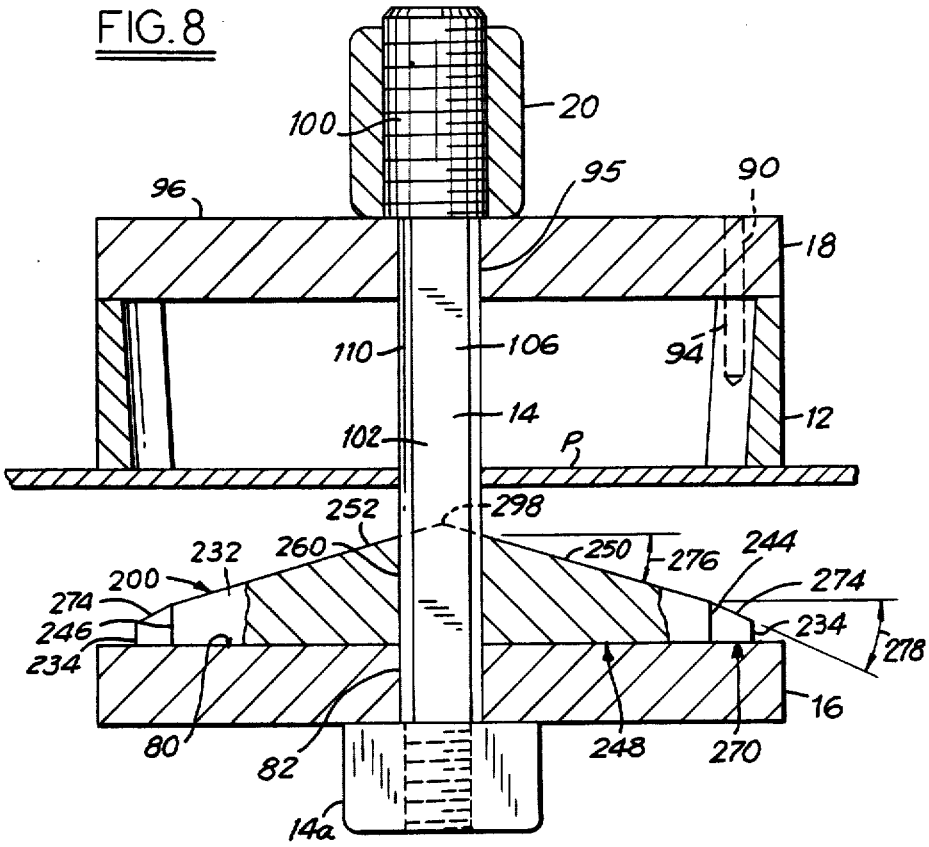
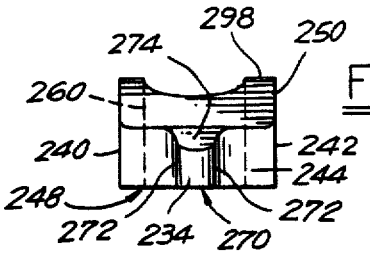
FIG. 9

PANEL PUNCH

FIELD OF THE INVENTION

The invention relates to punch and die constructions and, in particular, to punch and die constructions for punching holes in panels to receive electrical chassis connectors.

BACKGROUND OF THE INVENTION

U.S. Pat. No. 4,481,700 issued Nov. 13, 1984, to Larry Redmon illustrates a panel punch and die set wherein the punch and die are connected together on opposite sides of a panel by a plurality of threaded bolts. A plurality of holes to receive the bolts must be drilled in the panel first, however. The punch and die are configured to punch a generally trapezoidal hole in the panel to receive the main body of the electrical chassis connector. However, holes for mounting screws to actually mount the connector on the panel must be drilled in separate operations following the punching operation.

A panel punch and die set that requires drilling of only one pilot hole for a draw stud extending between the punch and die is illustrated in the Greenlee Tool Company catalog August, 1985 at p. 102 and designated RS-232 panel punch. The punch shown carries a portion to punch the trapezoidal opening in the panel and also carries a pair of lateral small round punch inserts circular holes, separate from the trapezoidal opening, in the panel for receiving the mounting screws for mounting the electrical connector panel.

Although the panel punch shown in the catalog performs satisfactorily in service, there is a need to reduce substantially the amount of force required to effect punching with that punch and die set. U.S. patent application Ser. No. 880,842, filed June 30, 1986, now U.S. Pat. No. 4,724,616, issued Feb. 166, 1988, for a Panel Punch addresses this problem and effects a force reduction.

SUMMARY OF THE INVENTION

The invention contemplates a panel punch having a main or primary punch for punching a trapezoidal or other opening for receiving an article or component, such as an electrical connector, and secondary punches on opposite ends of the main punch for punching narrow slots intersecting with and extending from the trapezoidal or other opening for receiving mounting means for the component, such as an electrical connector, to be positioned in the opening. Preferably, the secondary punches are integral with and extend from the main punch.

The invention also contemplates a mating die for the panel punch with the die having a main cavity to receive the main punch with clearance and secondary narrow slot-like cavities on opposite ends of the main cavity to receive the secondary punches with clearance.

The invention further contemplates panel punch of the type described hereinabove wherein the configuration of the secondary punch is blended with that of the main punch to produce a substantial reduction in force required to force the punch through the panel.

BRIEF DESCRIPTION OF THE DRAWINGS

FIG. 8 is a view similar to FIG. 2 of a punch and die assembly in accordance with the invention; and FIG. 9 is a right end view of the punch of FIG. 8.

DESCRIPTION OF THE PREFERRED EMBODIMENTS

Figure 1:
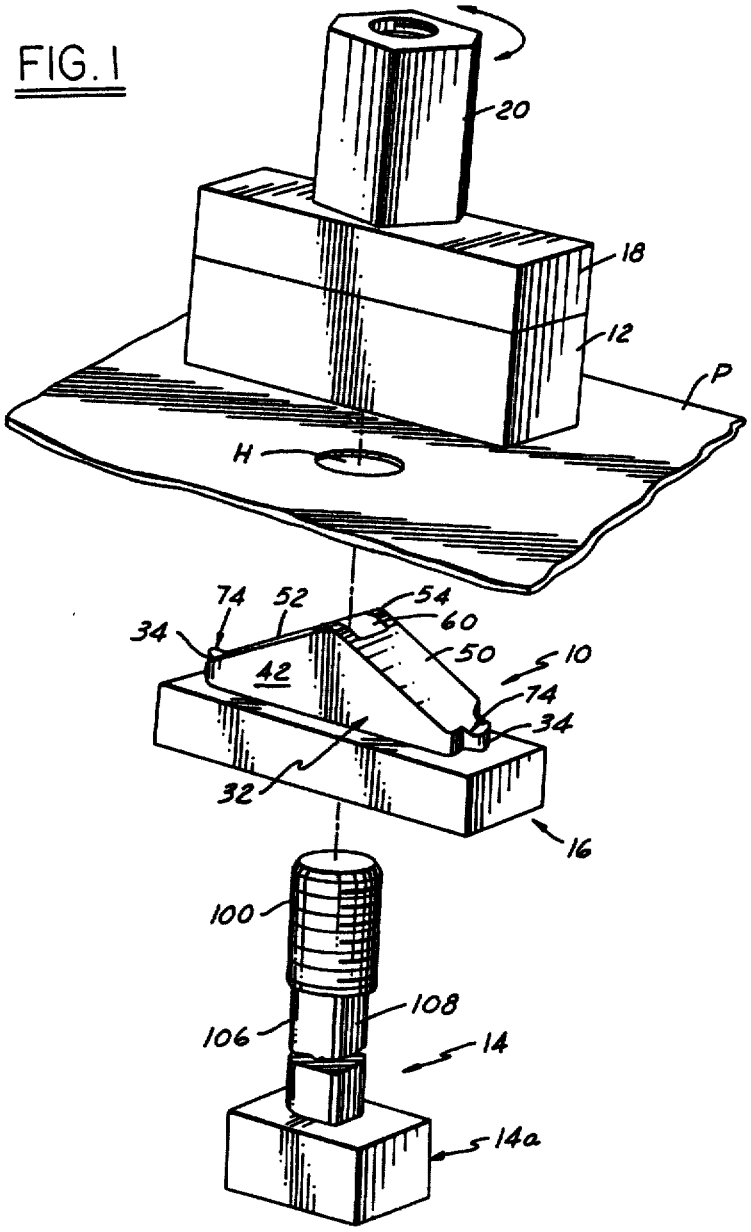
FIG. 1 is a perspective exploded view of a punch and die.
Figure 2:
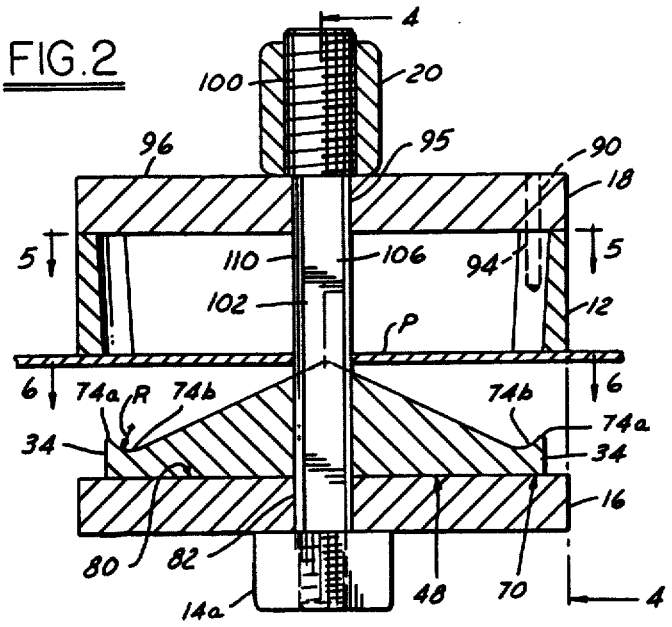
FIG. 2 is a partial cross-sectional view of the assembled punch and die assembly of FIG. 1 before penetration of the punch into the workpiece.
Figure 3:
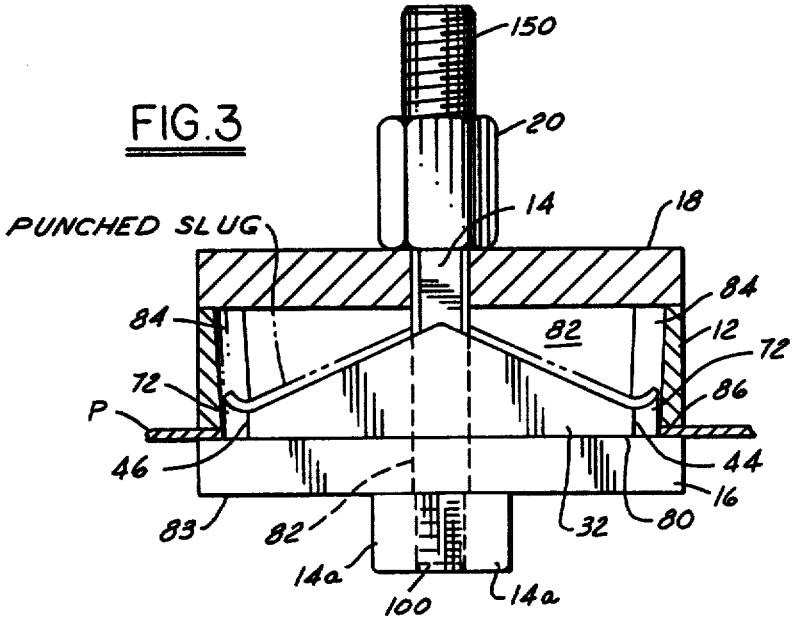
FIG. 3 is similar to FIG. 2 after punch penetration.

FIG. 1 illustrates a punch and die set having a punch 10, die 12, draw stud 14 with enlarged head **14*a*, punch follow plate 16, die alignment plate 18 and nut 20**. A section of panel P to be punched is shown between the punch and die and includes a pilot hole H of a size to receive the draw stud. As shown in FIGS. 2–3, the punch and die are assembled in working relation on opposite sides of the panel in known fashion with the punch ultimately received in the die after the opening is punched.

Figure 7:
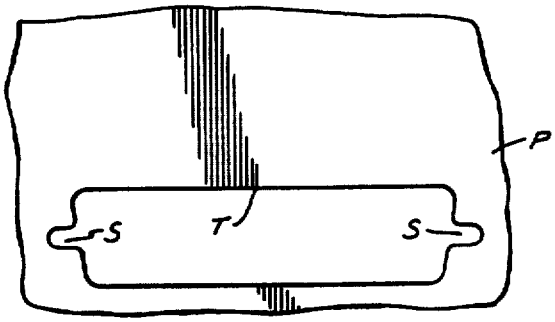
FIG. 7 is a plan view of the punched panel.

The punch 10 includes a main punch 32 configured as shown to punch a general trapezoidal opening T (FIG. 7) in panel P, and includes secondary punches 34 extending from opposite ends of the main punch 32 to punch generally U-shaped slots S intersecting with and extending from opposite ends of the trapezoidal opening, FIG. 7.

Figure 4:
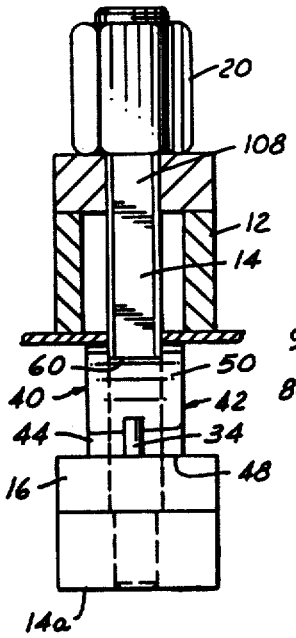
FIG. 4 is a partial end elevation of FIG. 3 in the direction of arrows 4—4 in FIG. 2.

In particular, the main punch 32 includes lateral working surfaces 40, 42 tapering slightly toward one another toward the surface 48 (FIG. 4) and with surface 40 shorter in length than surface 42 to provide the trapezoidal profile. The lateral working surfaces 40, 42 are connected at opposite ends by end working surfaces 44, 46 which taper toward one another from lateral working surface 42 toward lateral working surface 40 and from which the secondary punches 34 extend.

Flat surface 48 interconnects working surfaces 40, 42, 44, 46 on a side of the punch facing away from the die 12 when assembled. Inclined working surfaces 50, 52 and flat, narrow working surface 54 are provided on the opposite side of the punch from surface 48. Inclined working surfaces 50, 52 extend from flat working surface 54 in outwardly diverging relation toward the ends of the main punch and at equal angles relative thereto; e.g. about 24 ½° relative to the plane of working surface 54 until they intersect the respective end working surfaces 44, 46. Of course, inclined working surfaces 50, 52 also intersect the basically parallel lateral working surfaces 40, 42 as shown.

Figure 6:
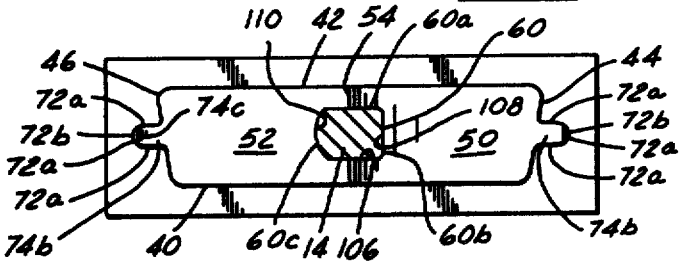
FIG. 6 is a sectional view taken along lines 6—6 of FIG. 2.

A bore or slot 60 extends from surface 48 to flat working surface 54 of the punch to receive the draw stud 14 when the punch and die are assembled in working relation on opposite sides of panel P. To this end, the profile or cross-section of slot 60 is complementary to that-of the draw stud but slightly larger in dimension to provide a controlled clearance therebetween. The slot 60 has parallel sides **60*a* connected by planar side 60*b* and arcuate side 60*c*** as shown in FIG. 6 to provide a D-shaped type slot profile so that the draw stud can only be inserted in one way therethrough.

Secondary punches 34 are integral with the main punch 32 and extend laterally in opposite directions from respective end working surfaces 44, 46. Each secondary punch 34 includes a surface 70 extending from surface 48 of the main punch 32. Each secondary punch 34 also includes a working surface 72 extending from the respective end working surface 44, 46 and comprising planar lateral working surfaces 72*a* and radial end working surface 72*b* interconnecting the planar lateral surfaces 72*a* as shown in FIG. 6. Radial surfaces 72*b* incline or taper toward one another and toward surface 70 as shown best in FIG. 2. Planar working surfaces 72*a* converge or taper toward one another slightly in the direction toward the surface 70.

Facing opposite from surface 70 is working surface 74 on each secondary punch 34. Each working surface 74 includes an outer working flat 74*a* and arcuate or radial working surface 74*b* extending from the flat 74*a* at the line of intersection 74*c* to and blended into the respective diverging inclined working surface 50, 52 on that end. Radial working surface 74*b* is defined by radius R and extends into the respective inclined working surface as shown in FIG. 2. It is apparent that arcuate working surface 74*b* of each secondary punch provides an arcuate recess between the flat working surface 74*a* and adjacent respective inclined working surface 50, 52. Each arcuate recess faces away from surface 70 toward the panel to be punched.

The taper or convergence provided on the various working surfaces of the punch as well as on the die, function to aid in stripping the punched slug from the punch.

As shown in FIGS. 2–5 the die 12 includes a main cavity 82 complementary in shape to the outer lateral profile of main punch 32 and secondary cavities 84 extending laterally from opposite sides of the main cavity and complementary in shape to the outer lateral profile of the respective secondary punches 34, except that the cavities 82, 84 are slightly larger in outer lateral or profile dimension so that the punches 32, 34 can be received with slight clearance therein during the punching operation Outer lateral profile refers to the lateral and end working surfaces of punches 32, 34 described hereinabove.

The internal working surfaces of the die 12 are provided with tapers generally complementary to the tapers on the lateral side working surfaces of punches 32, 34.

FIGS. 1–3 illustrate the punch follower plate 16 which is positioned with its side 80 against the punch surfaces 48, 70 and includes a bore 85 shaped to receive the draw stud 14. The side 83 of the punch follower plate opposite to side 80 thereof abuts draw stud head 14*a* when the punch and die set is assembled.

FIGS. 1–3 show the die alignment plate 18 which is fastened to the side of the die oppositely disposed from the side thereof which faces the punch and abuts the panel when assembled for punching. The die alignment plate 18 includes diagonally disposed bores 90 which receive machine screws 92 in turn threaded into threaded bores 94 in the die 12. Die alignment plate 18 includes a central bore 95 shaped to receive the draw stud 14. The side 96 of the die alignment plate abuts nut 20 on the draw stud when the punch and die is assembled.

Draw stud 14 is shown in FIGS. 1–3 and includes opposite threaded ends 100 on which nut 20 and draw stud head 14*a* are threaded as described hereinabove. An intermediate portion 102 is unthreaded. As mentioned hereinabove, the draw stud has a cross-sectional profile comprising parallel planar sides 106 interconnected by planar side 108 and arcuate side 110 to define a general D-type profile so that the draw stud can be positioned in the bores of the punch, die, punch follower plate and die alignment plate in only one way.

A punch and die set as described hereinabove has exhibited about a 25% reduction in the amount of force required to effect punching as compared to the force required for punching the same panel or material with the prior art punch RS-232 referred to hereinabove with no sacrifice in the quality of punched hole or opening produced.

The substantial reduction in required punching force is largely due to the integration of the main punch 32 and secondary punches 34 into a unitary punch and to the blending and configuration of the working punch surfaces with and relative to one another.

To effect punching once the punch and die set is assembled, the nut 20 is turned on the draw stud by a wrench to cause the punch to penetrate into the panel and ultimately into the die as is known. The punch and die set described can also be driven with other devices, such as ball screw drivers and hydro-ram drivers, known in the art.

In FIGS. 8 and 9, a punch and die in accordance with the invention are illustrated. The die 12, draw stud 14 with enlarged head 14*a*, punch follow plate 16, die alignment plate 18 and nut 20 are the same as illustrated in FIG. 2. Preceding descriptions applicable to those components in FIGS. 1–7 are also applicable in relation to FIG. 8.

The punch 200 includes a main punch 232 configured as shown to punch a general trapezoidal opening T (FIG. 7) in panel P, and includes secondary punches 234 extending from opposite ends of the main punch 232 to punch generally U-shaped slots S intersecting with and extending from opposite ends of the trapezoidal opening, FIG. 7.

In particular, the main punch 232 includes lateral working surfaces 240, 242 tapering slightly toward one another toward the surface 248 (FIG. 9) and with surface 240 shorter in length than the surface 242 to provide the trapezoidal profile The lateral working surfaces 240, 242 are connected at opposite ends by end working surfaces 244, 246 which taper toward one another from lateral working surface 242 toward lateral working surface 240 and from which the secondary punches 234 extend.

Flat surface 248 interconnects working surfaces 240, 242, 244, 246 on a side of the punch 200 facing away from the die 12 when assembled. Inclined working surfaces 250, 252 are provided on the opposite side of the punch from the surface 248. Inclined working surfaces 250, 252 extend from a central apex 298 in outwardly diverging relation toward the ends of the main punch 232 and at equal angles relative thereto until they intersect the respective end working surfaces 244, 246. The inclined working surfaces 250, 252 also intersect the basically parallel lateral working surfaces 240, 242 as shown in FIG. 9 It should also be appreciated that in an alternative embodiment of a punch in accordance with the invention, the apex 298 can be flattened to provide a narrow working surface such as working surface 54 illustrated in FIG. 1.

A bore or slot 260 extends from the surface 248 to the upper surfaces 250, 252 of the punch to receive the draw stud 14 when the punch and die are assembled in working relation on opposite sides of panel P. To this end, the profile or cross-section of the slot 260 is complementary to that of the draw stud but slightly larger in dimension to provide a controlled clearance therebetween. The slot 260 has parallel sides connected by a planar side and arcuate side to provide a D-shaped type slot profile so that the draw stud 14 can only be inserted in one way therethrough to correspond with positioning of the draw stud in the other elements of the assembled device.

Figure 5:
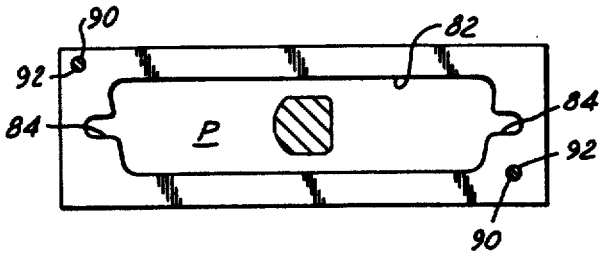
FIG. 5 is a view of the die taken along line 5—5 of FIG. 2.

The secondary punches 234 are integral with the main punch 232 and extend laterally in opposite direction from respective end working surfaces 244, 246. Each secondary punch 234 includes a surface 270 extending from the surface 248 of the main punch 242. Each secondary punch 234 also includes a working surface 272 extending generally parallel to the longitudinal axis of the bolt 14 from the respective end working surface 244, 246. This surface 272 reverses itself in a radial bend and returns to the respective surface 244, 246 to form contours as illustrated in FIGS. 5, 6 and 7 for the slots S which are formed by the die.

As is apparent upon examination, the primary difference between the punch 200 of FIGS. 8 and 9 and the punch 10 of FIGS. 1–6 is in the slope of the secondary punches 234 as compared to the secondary punches 34. In FIG. 8, it can be seen that the upper working surfaces 274 of the secondary punches 234 slope downwardly relative to the working surfaces 250, 252 of the main punch 232 whereas in the punch of FIG. 1, the secondary punches have working surfaces 74 which turn upwardly relative to the surfaces 50, 52 of the primary punch 32. In other words, the down-sloping angle 276 for the primary punch working surfaces 250, 252 is less than the angle 278 for the working surfaces 274 of the secondary punches 234.

To produce the very same cutout pattern in a panel P as illustrated in FIG. 7, use of a punch 200 lowers the peak force that is required for punching the opening. Additionally, the total stroke is much reduced. Normally, when the stroke is reduced, the force increases in inverse proportion because the energy or work expended remains the same. When the primary punch angle 276 is 10° and the angle 278 of the secondary punches is 20°, the stroke has been reduced to one half that required with the punch of FIG. 1 without any increase in peak force and the energy or work expended has been reduced to 55% of that required by the punch of FIG. 1. This is the result of a unique combination of the two angles 276, 278.

Further, it has been found that if the angle 276 on the primary punch is increased above 10°, the peak force of first penetration into the panel P is lowered while the stroke is increased, but the force when the secondary punches become active is not reduced. If the primary angle 276 of the primary punch is decreased below 10°, the peak force due to the primary punch is higher than the peak force produced by the secondary punches and this is undesirable.

If the secondary angle 278 of the secondary punches is reduced below 20°, for example, to 10°, making it a continuation of the primary punch surface, the force required when secondary punches become active is increased. If the secondary punch angle 278 is increased above 20°, there is not a further reduction in peak force and stroke is unnecessarily increased.

Thus, the combination of primary and secondary angles is unique in achieving a minimum force and minimum energy from a functional standpoint. Although variations exist as the angles are changed, satisfactory performance is achieved when the primary punch angle 276 is in the range of 10° plus 5° minus i.e., preferably 10°, but acceptable with a range of 8° to 15° and the secondary punch angle 278 is in the range of 20° plus or minus 5°. It is noteworthy that the angle on the primary punch 12 in FIG. 1 was in the order of 24 ½°.

While certain specific and preferred embodiments of the invention have been described in detail hereinabove, those skilled in the art will recognize that various modifications and changes can be made therein within the scope of the appended claims which are intended to include equivalents of such embodiments.

What is claimed is:

1. A punch for punching an opening in a panel for an article comprising: a main punch having ends, a base, a pair of spaced apart lateral working surfaces and a pair of inclined working surfaces spaced from said base, said inclined working surfaces extending between said spaced apart lateral working surfaces; said inclined working surfaces each extending toward said base to a respective end of said main punch in diverging relation to one another and configured to punch said opening in the panel for receiving the article; at least one secondary punch having a pair of spaced apart lateral working surfaces and an inclined working surface, said inclined working surface extending between said spaced apart lateral surfaces and being configured for punching a secondary opening intersecting with and extending from said opening for receiving the article, said secondary opening being configured for receiving mounting means for attaching said article to the panel, said at least one secondary punch extending from one of said respective ends of the main punch and terminating in a remote secondary punch end, said at least one secondary punch having said inclined working surface thereof integrally interconnecting with an adjacent one of the inclined working surfaces of said main punch, the maximum height of said secondary punch inclined working surface relative to said base not exceeding the minimum height of said main punch inclined working surfaces and the height relative to said base of said secondary punch end being less than the maximum height of said secondary punch inclined working surface.

2. The punch as claimed in claim 1, wherein the main punch is configured to punch a predeterminedly shaped opening in said panel comprising the opening for receiving the article and said at least one secondary punch is configured to punch a U-shaped slot in the panel extending from the predeterminedly shaped opening and comprising said secondary opening.

3. A punch as claimed in claim 1, wherein said inclined working surfaces of said main punch each extend to a respective end of said main punch, and said secondary punch working surface is planar.

4. A punch as claimed in claim 3, wherein said main punch inclined working surfaces have an angle of 10° plus 5° minus 2° relative to said base and said working surface of said secondary punch has an angle of 20° plus or minus 5° relative to said base.

5. A punch as claimed in claim 1, wherein said inclined working surfaces of said main punch and said secondary punch inclined working surface are planar, and the angle of said main punch inclined working surfaces relative to said base is less than the angle of said secondary punch working surface relative to said base.

6. A punch as claimed in claim 5, wherein said main punch inclined working surfaces have an angle of 10° plus 5° minus 2° relative to said base and said inclined working surface of said secondary punch has an angle of 20° plus or minus 5° relative to said base.

7. A punch as claimed in claim 5, wherein said main punch inclined working surface have an angle of 10° relative to said base and said working surface of said secondary punch has an angle of 20° relative to said base.

8. A punch as claimed in claim 1, and further including a shaped bore, said bore being configured to receive a draw stud operatively connecting said punch with a die.

9. A punch as claimed in claim 8, wherein said shaped bore has a D-shaped cross-sectional profile.

10. A punch as claimed in claim 1, in combination with a die having a main cavity to receive said main punch and at least one secondary cavity extending from an end of said main cavity to receive said at least one secondary punch.

11. A punch as claimed in claim 10, wherein said inclined working surfaces of said main punch and said secondary punch inclined working surface are planar, the angle of said main punch inclined working surfaces relative to said base is less than the angle of said second punch inclined working surface relative to said base.

12. A punch as claimed in claim 11, wherein said main punch inclined working surfaces have an angle of 10° plus 5° minus 2° relative to said base and said inclined working surfaces of said secondary punch has an angle of 20° plus or minus 5° relative to said base.

* * * * *

UNITED STATES PATENT AND TRADEMARK OFFICE

CERTIFICATE OF CORRECTION

PATENT NO. : 4,899,447

DATED : February 13, 1990

INVENTOR(S) : Larry Adleman

It is certified that error appears in the above-identified patent and that said Letters Patent is hereby corrected as shown below:

Column 1 Line 38 "issued Feb. 166, 1988" it should be

— issued Feb. 16, 1988 —

Column 6 Line 6 "10°plus 5°minus i.e.," it should be

—10°plus 5°minus 2°i.e.,—

Column 8 Line 12 "said second punch" it should be

— said secondary punch —

Signed and Sealed this

Twenty-first Day of April, 1992

*Attest:*

HARRY F. MANBECK, JR.

*Attesting Officer*

*Commissioner of Patents and Trademarks*